US006492322B1

(12) United States Patent
Cooper et al.

(10) Patent No.: US 6,492,322 B1
(45) **Date of Patent: *Dec. 10, 2002**

(54) CONCENTRATED QUATERNARY AMMONIUM FABRIC SOFTENER COMPOSITIONS CONTAINING CATIONIC POLYMERS

(75) Inventors: Megan A. Cooper, Columbus, OH (US); Toan Trinh, Maineville, OH (US); Errol Hoffman Wahl, Cincinnati, OH (US); Richard Martin Ward, Mason, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,086

(22) PCT Filed: Sep. 19, 1997

(86) PCT No.: PCT/US97/16690

§ 371 (c)(1),
(2), (4) Date: Mar. 18, 1999

(87) PCT Pub. No.: WO98/12293

PCT Pub. Date: Mar. 26, 1998

Related U.S. Application Data

(60) Provisional application No. 60/026,442, filed on Sep. 19, 1996.

(51) Int. Cl.[7] ..... C11D 3/37

(52) U.S. Cl. ..... 510/516; 510/522; 510/527

(58) Field of Search ..... 510/516, 522, 510/524, 527

(56) References Cited

U.S. PATENT DOCUMENTS

| | | | | | |
|---|---|---|---|---|---|
| 5,501,806 | A | * | 3/1996 | Farooq et al. | 252/8.8 |
| 5,545,350 | A | * | 8/1996 | Baker et al. | 510/517 |
| 5,747,443 | A | * | 5/1998 | Wahl et al. | 510/515 |
| 5,861,370 | A | * | 1/1999 | Trinh et al. | 510/504 |

FOREIGN PATENT DOCUMENTS

| | | | |
|---|---|---|---|
| EP | 0 394 133 A1 | 10/1990 | C11D/3/37 |

* cited by examiner

*Primary Examiner*—John Hardee
(74) *Attorney, Agent, or Firm*—Jason J. Camp; Kim William Zerby; Steven W. Miller

(57) ABSTRACT

The present invention relates to aqueous stable, preferably concentrated, aqueous liquid textile softening compositions comprising fabric softener active and cationic polymer in the continuous aqueous phase to provide improved softening. The compositions of the present invention preferably contain diester quaternary ammonium compounds wherein the fatty acyl groups have an Iodine Value of from greater than about 5 to less than about 140. The cationic polymers can provide additional benefits such as dye transfer inhibition, chlorine scavenging to protect fabrics, cotton soil release benefits, etc.

19 Claims, No Drawings

CONCENTRATED QUATERNARY AMMONIUM FABRIC SOFTENER COMPOSITIONS CONTAINING CATIONIC POLYMERS

This application claims the benefit of provisional application No. 60/026,442 filed Sep. 19, 1996.

TECHNICAL FIELD

The present invention relates to stable, homogeneous, preferably concentrated, aqueous liquid textile treatment compositions containing softening compounds, preferably, biodegradable, and cationic polymers. In particular, it especially relates to textile softening compositions for use in the rinse cycle of a textile laundering operation to provide excellent fabric softening/static control benefits, as well as a range of other benefits, the compositions being characterized by excellent storage and viscosity stability, as well as, superior fabric softening performance.

BACKGROUND OF THE INVENTION

The art discloses many problems associated with formulating and preparing stable fabric conditioning formulations. See, for example, U.S. Pat. No. 3,904,533, Neiditch et al. issued Sept. 9, 1975. Japanese Laid Open Publication 1,249,129, filed Oct. 4, 1989, discloses a problem with dispersing fabric softener actives containing two long hydrophobic chains interrupted by ester linkages ("diester quaternary ammonium compounds") and solves it by rapid mixing. U.S. Pat. No. 5,066,414, Chang, issued Nov. 19, 1991, teaches and claims compositions containing mixtures of quaternary ammonium salts containing at least one ester linkage, nonionic surfactant such as a linear alkoxylated alcohol, and liquid carrier for improved stability and dispersibility. U.S. Pat. No. 4,767,547, Straathof et al., issued Aug. 30, 1988, claims compositions containing either diester, or monoester quaternary ammonium compounds where the nitrogen has either one, two, or three methyl groups, stabilized by maintaining a critical low pH of from 2.5 to 4.2.

U.S. Pat. No. 4,401,578, Verbruggen, issued Aug. 30, 1983 discloses hydrocarbons, fatty acids, fatty acid esters, and fatty alcohols as viscosity control agents for fabric softeners (the fabric softeners are disclosed as optionally comprising ester linkages in the hydrophobic chains). WO 89/115 22-A (DE 3,818,061-A; EP-346,634-A), with a priority of May 27, 1988, discloses diester quaternary ammonium fabric softener components plus a fatty acid. European Pat. No. 243,735 discloses sorbitan esters plus diester quaternary ammonium compounds to improve dispersions of concentrated softener compositions.

Diester quaternary ammonium compounds with a fatty acid, alkyl sulfate, or alkyl sulfonate anion are disclosed in European Pat. No. 336,267-A with a priority of Apr. 2, 1988. U.S. Pat. No. 4,808,321, Walley, issued Feb. 28, 1989, teaches fabric softener compositions comprising monoester analogs of ditallow dimethyl ammonium chloride which are dispersed in a liquid carrier as sub-micron particles through high shear mixing, or particles can optionally be stabilized with emulsifiers such as nonionic $C_{14-18}$ ethoxylates.

E.P. Appln. 243,735, Nusslein et al., published Nov. 4, 1987, discloses sorbitan ester plus diester quaternary ammonium compounds to improve dispersibility of concentrated dispersions.

E.P. Appln. 409,502, Tandela et al., published Jan. 23, 1991, discloses, e.g., ester quaternary ammonium compounds, and a fatty acid material or its salt.

E.P. Appln. 240,727, Nusslein et al., priority date of Mar. 12, 1986, teaches diester quaternary ammonium compounds with soaps or fatty acids for improved dispersibility in water.

The art also teaches compounds that alter the structure of diester quaternary ammonium compounds by substituting, e.g., a hydroxy ethyl for a methyl group or a polyalkoxy group for the alkoxy group in the two hydrophobic chains. Specifically, U.S. Pat. No. 3,915,867, Kang et al., issued Oct. 28, 1975, discloses the substitution of a hydroxyethyl group for a methyl group. A softener material with specific cis/trans content in the long hydrophobic groups is disclosed in Jap. Pat. Appln. 63-194316, filed Nov. 21, 1988. Jap. Pat. Appln. 4-333,667, published Nov. 20, 1992, teaches liquid softener compositions containing diester quaternary ammonium compounds having a total saturated:unsaturated ratio in the ester allyl groups of 2:98 to 30:70.

The art teaches the addition of cationic polymers to rinse added fabric softening compositions for a variety of benefits. U.S. Pat. No. 4,386,000, (EPA 0,043,622), Turner, Dovey, and Macgilp, discloses such polymers as part of a viscosity control system in relatively concentrated compositions containing relatively non-biodegradable softener actives. U.S. Pat. No. 4,237,016, (EPA 0,002,085), Rudkin, Clint, and Young, disclose such materials as part of softening compositions with low levels of relatively non-biodegradable fabric softening actives to make them more effective and to allow substitution of nonionic fabric softening actives for part of the softener. U.S. Pat. No. 4,179,382, Rudkin, Clint, and Young, also discloses the softener improvement that can be obtained with relatively non-biodegradable fabric softener actives by incorporating cationic polymers. Recently, it has also been discovered that such polymers also can improve dye fastness, protect fabrics against residual hypochlorite bleach etc.

All of the above patents and patent applications are incorporated herein by reference.

SUMMARY OF THE INVENTION

The present invention provides textile softening compositions with excellent static control, softening, dye protection, and/or bleach protection, having good storage stability for concentrated aqueous compositions and improved performance. In addition, these compositions provide these benefits under worldwide laundering conditions and minimize the use of extraneous ingredients for stability and static control to decrease environmental chemical load.

The fabric softening compounds of the present invention are quaternary ammonium compounds, preferably relatively biodegradable, due to their containing ester and/or amide linkages, preferably ester linkages, wherein the fatty acyl groups (1) preferably have an IV of from greater than about 5 to less than about 140, (2) preferably a cis/trans isomer weight ratio of greater than about 30/70 when the IV is less than about 25, and/or (3) the level of unsaturation preferably being less than about 65% by weight, wherein said compounds are capable of forming concentrated aqueous compositions with concentrations greater than about 13% by weight.

The compositions can be aqueous liquids, preferably concentrated, containing from about 2% to about 60%, preferably from about 10% to about 50%, more preferably from about 15% to about 40%, and even more preferably from about 20% to about 35%, of said preferably biodegradable, preferably diester, softening compound and from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meqlgm., preferably from about 0.1 to about 8 meq/gm., more preferably from about 0.5 to about 7, and even more preferably from about 2 to about 6. In order to provide the benefits of the cationic polymers, and especially cationic polymers containing amine, or imine, groups, said cationic polymer is primarily in the continuous aqueous phase.

DETAILED DESCRIPTION OF THE INVENTION

The Fabric Softening Compounds

The fabric softening compounds can include the relatively non-biodegradable compounds disclosed in U.S. Pats. Nos. 4,386,000; 4,237,016; and 4,179,382, incorporated hereinbefore by reference. Other fabric softening compounds are disclosed in U.S. Pat. No. 4,103,047, Zaki et al., issued Jul. 25, 1978; U.S. Pat. No. 4,237,155, Kardouche, issued Dec. 2, 1980; U.S. Pat. No. 3,686,025, Morton, issued Aug. 22, 1972; U.S. Pat. No. 3,849,435, Diery et al., issued Nov. 19, 1974; and U.S. Pat. No. 4,073,996, Bedenk, issued Feb. 14, 1978; U.S. Pat. No. 4,661,269, Toan Trinh, Errol H. Wahl, Donald M. Swartley and Ronald L. Hemingway, issued Apr. 28, 1987; U.S. Pat. No.: 3,408,361, Mannheimer, issued Oct. 29, 1968; U.S. Pat. No. 4,709,045, Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sept. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; and U.S. Pat. No. 4,339,391, Hoffman et al., issued Jul. 13, 1982, all of said patents being incorporated herein by reference. However, the preferred fabric softening compounds are biodegradable, especially as described hereinafter.

(A) Diester/diamido Quaternary Ammonium Compound (DEQA)

The present invention preferably relates to DEQA compounds and compositions containing DEQA as a component:

DEQA having the formula:

$$(R)_{4-m}—N^+—[(CH_2)_n—Y—R^2]_mX^-$$

wherein each Y=—O—(O)C—, or —C(O)—O—, —NR—(O)C—, or —C(O)—NR—, preferably —O—(O)C—, or —C(O)—O—, and more preferably —O—(O)C—;

m=2 or 3;

each n=1 to 4;

each R substituent is a short chain $C_1$–$C_6$, preferably $C_1$–$C_3$, alkyl or hydroxyalkyl group, e.g., methyl (most preferred), ethyl, 2-hydroxyethyl, propyl, and the like, benzyl or mixtures thereof;

each $R^2$ is a long chain, preferably at least partially unsaturated [IV preferably greater than about 5 to less than about 140, preferably from about 40 to about 140, more preferably from about 60 to about 130; and most preferably from about 70 to about 105 (As used herein, the Iodine Value of the "parent" fatty acid, or "corresponding" fatty acid, is used to define an average level of unsaturation for all of the $R^1$ groups that are present, that is the same as the level of unsaturation that would be present in fatty acids containing the same $R^1$ groups.)], $C_{11}$–$C_{21}$ hydrocarbyl, or substituted hydrocarbyl substituent and the counterion, $X^-$, can be any softener-compatible anion, for example, chloride, bromide, methylsulfate, formate, sulfate, nitrate and the like.

DEQA compounds prepared with fully saturated acyl groups are rapidly biodegradable and excellent softeners. However, compounds prepared with at least partially unsaturated acyl groups have many advantages (i.e., concentratability and good storage viscosity) and are highly acceptable for consumer products when certain conditions are met. When such compounds are formulated at high concentrations and the cationic polymers are present, the compositions containing even such compounds tend to be unstable. At lower concentrations, the cationic fabric softener actives can be more, or completely, saturated, and can be less readily biodegradable, like those disclosed in U.S. Pat. Nos.: 4,386,000; 4,237,016; and 4,179,382, incorporated hereinbefore by reference, but these options are not desirable, due to the desire to limit the use of such materials.

Variables that can be adjusted to obtain the benefits of using unsaturated acyl groups include the Iodine Value (IV) of the fatty acids; the cis/trans isomer weight ratios in the fatty acyl groups; and the odor of fatty acid and/or the DEQA. Any reference to IV hereinafter refers to IV of fatty acyl groups and not to the resulting DEQA compound.

When the IV of the fatty acyl groups is above about 20, the DEQA provides excellent antistatic effect. Antistatic effects are especially important where the fabrics are dried in a tumble dryer, and/or where synthetic materials which generate static are used. Maximum static control occurs with an IV of greater than about 20, preferably greater than about 40. When fully saturated DEQA compositions are used, poor static control results. Also, as discussed hereinafter, concentratability increases as IV increases. The benefits of concentratability include: use of less packaging material; use of less organic solvents, especially volatile organic solvents; use of less concentration aids which may add nothing to performance; etc.

As the IV is raised, there is a potential for odor problems. Surprisingly, some highly desirable, readily available sources of fatty acids such as tallow, possess odors that remain with the compound DEQA despite the chemical and mechanical processing steps which convert the raw tallow to finished DEQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is typically justified by the superior concentratability and/or performance.

DEQA derived from highly unsaturated fatty acyl groups, i.e., fatty acyl groups having a total unsaturation above about 65% by weight can provide benefits such as improved water absorbency of the fabrics. In general, an IV range of from about 40 to about 140 is preferred for concentratability, maximization of fatty acyl sources, excellent softness, static control, etc.

Highly concentrated aqueous dispersions of these diester compounds can gel and/or thicken during low (40° F) temperature storage. Diester compounds made from only unsaturated fatty acids minimizes this problem but additionally is more likely to cause malodor formation. Surprisingly, compositions from these diester compounds made from fatty acids having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these IV ranges. In the IV range above about 25, the ratio of cis to trans isomers is less important unless higher concentrations are needed. The relationship between IV and concentratability is described hereinafter. For any IV, the concentration that will be stable in an aqueous composition will depend on the criteria for stability (e.g., stable down to about 5° C.; stable down to 0° C., doesn't gel; gels but recovers on heating, etc.) and the other ingredients present, but the concentration that is stable can be raised by adding the concentration aids, described hereinafter in more detail, to achieve the desired stability. However, as described hereinafter, when the cationic polymer is present, the level, and identity of the polymer affect the stability, and the selection must be made to provide the desired stability according to the criteria disclosed herein.

Generally, hydrogenation of fatty acids to reduce polyunsaturation and to lower IV to insure good color and improve odor and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid 406 from FINA).

It has also been found that for good chemical stability of the diester quaternary compound in molten storage, moisture level in the raw material should be controlled and minimized preferably less than about 1% and more preferably less than about 0.5% water. Storage temperatures should be kept as low as possible and still maintain a fluid material, ideally in the range of from about 120° F. to about 150° F. The optimum storage temperature for stability and fluidity depends on the specific IV of the fatty acid used to make the diester quaternary and the level/type of solvent selected. It is important to provide good molten storage stability to provide a commercially feasible raw material that will not degrade noticeably in the normal transportation/storage/handling of the material in manufacturing operations.

Compositions of the present invention preferably contain the following levels of DEQA: from about 5% to about 50%, preferably from about 15% to about 40%, more preferably from about 15% to about 35%, and even more preferably from about 15% to about 32%.

It will be understood that substituents R and $R^2$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the DEQA is in the diester form, and from 0% to about 20%, preferably less than about 10%, more preferably less than about 6%, can be DEQA monoester (e.g., only one —Y—$R^2$ group).

As used herein, when the diester is specified, it will include the monoester that is normally present. The level of monoester present can be controlled in the manufacturing of the DEQA. For softening, under no/low detergent carry-over laundry conditions the percentage of monoester should be as low as possible, preferably no more than about 2.5%. The cationic polymer typically allows this same material containing only low levels of monoester to be used, even under detergent carry-over conditions. Only low levels of cationic polymer are needed for this purpose, i.e., ratios of fabric softener active to polymer of from about 1000:1 to about 2.5:1, preferably from about 500:1 to about 20:1, more preferably from about 200:1 to about 50:1. Under high detergent carry-over conditions, the ratio is preferably about 100:1.

The following are non-limiting examples (wherein all long-chain alkyl substituents are straight-chain):

Saturated $[HO—CH(CH_3)CH_2][CH_3]^+N[CH_2CH_2OC(O)C_{15}H_{31}]_2Br^-$ $[C_2H_5]_2N^+[CH_2CH_2OC(O)C_{17}H_{35}]_2Cl^-$ $[CH_3][C_2H_5]^+N[CH_2CH_2OC(O)C_{13}H_{27}]_2I^-$ $[C_3H_7][C_2H_5]^+N[CH_2CH_2OC(O)C_{15}H_{31}]_2SO_4$—CH3

$[CH_3]_2^+N—[CH_2CH_2OC(O)C_{15}H_{31}][CH_2CH_2OC(O)C_{17}H_{35}]Cl^-$ $[CH_3]_2^+N[CH_2CH_2OC(O)R^2]_2Cl^-$ where —$C(O)R^2$ is derived from saturated tallow.

Unsaturated $[HO—CH(CH_3)CH_2][CH_3]^+N[CH_2CH_2OC(O)C_{15}H_{29}]_2Br^-$ $[C_2H_5]_2^+N[CH_2CH_2OC(O)C_{17}H_{33}]_2Cl^-$ $[CH_3][C_2H_5]^+N[CH_2CH_2OC(O)C_{13}H_{25}]_2I^-$ $[C_3H_7][C_2H_5]^+N[CH_2CH_2OC(O)C_{15}H_{24}]_2SO_4—CH_3$ $[CH_3]_2^+N—[CH_2CH_2OC(O)C_{15}H_{29}][CH_2CH_2OC(O)C_{17}H_{33}]Cl^-$ $[CH_2CH_2OH][CH_3]^+N[CH_2CH_2OC(O)R^2]_2Cl^-$ $[CH_3]_2^+N[CH_2CH_2OC(O)R^2]_2Cl^-$ where —$C(O)R^2$ is derived from partially hydrogenated tallow or modified tallow having the characteristics set forth herein.

In addition, since the foregoing compounds (diesters) are somewhat labile to hydrolysis, they should be handled rather carefully when used to formulate the compositions herein. For example, stable liquid compositions herein are formulated at a pH in the range of from about 2 to about 5, preferably from about 2 to about 4.5, more preferably from about 2.5 to about 4. For best product odor stability, when the IV is greater that about 25, the pH is from about 2.8 to about 3.5, especially for "unscented" (no perfume) or lightly scented products. This appears to be true for all DEQAs, but is especially true for the preferred DEQA specified herein, i.e., having an IV of greater than about 20, preferably greater than about 40. The limitation is more important as IV increases. The pH can be adjusted by the addition of a Bronsted acid. The pH ranges above are determined without prior dilution of the composition with water.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

(B) Cationic Polymer

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and co-polymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary", Fourth Edition, J. M. Nikitakis, et al, Editors, published by the Cosmetic, Toiletry, and Fragrance Association, 1991, incorporated herein by reference. The list includes the following:

Polyquaternium-1

CAS Number: 68518-54-7

Definition: Polyquaternium-1 is the polymeric quaternary ammonium salt that conforms generally to the formula:

$$\{(HOCH_2CH_2)_3N^+—CH_2CH{=}CHCH_2—[N^+(CH_3)_2—CH_2CH{=}CHCH_2]_x—N^+(CH_2CH_2OH)_3\}[Cl^-]_{x+2}$$

Polyquaternium-2

CAS Number: 63451-274

Definition: Polyquaternium-2 is the polymeric quaternary ammonium salt that conforms generally to the formula:

$$[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$$

Other Names: Mirapol A-15 (Rhône-Poulenc)

Polyquaternium-4

Definition: Polyquaternium-4 is a copolymer of hydroxyethylcellulose and diallyldimethyl ammonium chloride.

Other Names:

- Celquat H 100 (National Starch)
- Celquat L200 (National Starch)
- Diallyldimonium Chloride/Hydroxyethyl-cellulose Copolymer Polyquaternium-5

CAS Number: 26006-224

Definition: Polyquaternium-5 is the copolymer of acrylamide and beta-methacrylyloxyethyl trimethyl ammonium methosulfate.

Other Names:

- Ethanaminium, N,N,N-Trimethyl-N-2-[(2-Methyl-1-Oxo-2-Propenyl)Oxy]-, Methyl Sulfate, Polymer with 2-Propenamide
- Nalco 7113 (Nalco)
- Quaternium-39
- Reten 210 (Hercules)
- Reten 220 (Hercules)
- Reten 230 (Hercules)
- Reten 240 (Hercules)
- Reten 1104 (Hercules)
- Reten 1105 (Hercules)
- Reten 1106 (Hercules)

Polyquaternium-6

CAS Number: 26062-79-3

Empirical Formula: $(C_8H_{16}N.Cl)_x$

Definition: Polyquaternium-6 is a polymer of dimethyl diallyl ammonium chloride.

Other Names:

- Agequat-400 (CPS)
- Conditioner P6 (3V-SIGMA)
- N,N-Dimethyl-N-2-Propenyl-2-Propen-1-aminium Chloride, Homopolymer
- Hoe S 3654 (Hoechst AG)
- Mackernium 006 (McIntyre)
- Merquat 100 (Calgon)
- Nalquat 6-20 (Nalco)
- Poly-DAC 40 (Rhône-Poulenc)
- Poly(Dimethyl Diallyl Ammonium Chloride)
- Poly(DMDAAC)
- 2-Propen-1-aminium, N,N-Dimethyl-N-2-Propenyl-, Chloride, Homopolymer
- Quaternium-40
- Salcare SC30 (Allied Colloids)

Polyquaternium-7

CAS Number: 26590-05-6

Empirical Formula: $(C_8H_{16}N.C_3H_5NO.Cl)_x$

Definition: Polyquaternium-7 is the polymeric quaternary ammonium salt consisting of acrylamide and dimethyl diallyl ammonium chloride monomers.

Other Names:

- Agequat-500 (CPS)
- Agequat-5008 (CPS)
- Agequat C-505 (CPS)
- Conditioner P7 (3V-SIGMA)
- N,N-Dimethyl-N-2-Propenyl-2-Propen-1-aminium Chloride, Polymer with 2-Propenamide
- Mackernium 007 (McIntyre)
- Merquat 550 (Calgon)
- Merquat S (Calgon)
- 2-Propen-1-aminium, N,N-Dimethyl-N-2-Propenyl-, Chloride, Polymer with 2-Propenamide
- Quaternium-41
- Salcare SC10 (Allied Colloids)

Polyquaternium-8

Definition: Polyquaternium-8 is the polymeric quaternary ammonium salt of methyl and stearyl dimethylaminoethyl methacrylate quaternized with dimethyl sulfate.

Other Names:

- Methyl and Stearyl Dimethylaminoethyl Methacrylate Quaternized with Dimethyl Sulfate Quaternium-42

Polyquaternium-9

Definition: Polyquaternium-9 is the polymeric quaternary ammonium salt of polydimethylaminoethyl methacrylate quaternized with methyl bromide.

Other Names:

- Polydimethylaminoethyl Methacrylate Quaternized with Methyl Bromide Quaternium-49

Polyquaternium-10

CAS Numbers: 53568-66-4; 55353-19-0; 54351-50-7; 81859-24-7; 68610-92-4; 81859-24-7

Definition: Polyquaternium-10 is a polymeric quaternary ammonium salt of hydroxyethyl cellulose reacted with a trimethyl ammonium substituted epoxide.

Other Names:

Cellulose, 2-[2-Hydroxy-3-Trimethylammono)propoxy] Ethyl ether, chloride

Celquat SC-240 (National Starch)

Quaternium-19

UCARE Polymer JR-125 (Amerchol)

UCARE Polymer JR-400 (Amerchol)

UCARE Polymer JR-30M (Amerchol)

UCARE Polymer LR 400 (Amerchol)

UCARE Polymer LR 30M (Amerchol)

Ucare Polymer SR-10 (Amerchol)

Polyquaternium-11

Empirical Formula: $(C_8H_{15}NO_2.C_6H_9NO)_x.xC_4H_{10}O_4S$

Definition: Polyquaternium-11 is a quaternary ammonium polymer formed by the reaction of diethyl sulfate and a copolymer of vinyl pyrrolidone and dimethyl aminoethylmethacrylate.

Other Names:

Gafquat 734 (GAF)

Gafquat 755 (GAF)

Gafquat 755N (GAF)

2-Propenol Acid, 2-Methyl-2-(Dimethylamino)Ethyl Ester, Polymer and 1-Ethenyl-2-Pyrrolidinone, Compound with Diethyl Sulfate 2-Pyrrolidinone, 1-Ethenyl-Polymer and 2-(Dimethylamino)Ethyl 2-Methyl-2-Propenoate, Compound and Diethyl Sulfate 2-Pyrrolidinone, 1-Ethenyl-, Polymer and 2-Dimethylamino)Ethyl 2-Methyl-2-Propenoate, compound with Diethyl Sulfate Quaternium-23

Polyquaternium-12

CAS Number: 68877-50-9

Definition: Polyquaternium-12 is a polymeric quaternary ammonium salt prepared by the reaction of ethyl methacrylate/abietyl methacrylate/diethylaminoethyl methacrylate copolymer with dimethyl sulfate.

Other Names:

Ethyl Methacrylate/Abietyl Methacrylate/Diethylaminoethyl

Methacrylate-Quaternized with Dimethyl Sulfate

Quaternium-37

Polyquaternium-13

CAS Number: 68877-47-4

Definition: Polyquaternium-13 is a polymeric quaternary ammonium salt prepared by the reaction of ethyl methacrylate/oleyl methacrylate/diethylaminoethyl methacrylate copolymer with dimethyl sulfate.

Other Names:

Ethyl Methacrylate/Oleyl Methacrylate/Diethylaminoethyl Methacrylate-Quaternized with Dimethyl Sulfate Quaternium 38

Polyquaternium-14

CAS Number: 27103-90-8

Definition: Polyquaternium-14 is the polymeric quaternary ammonium salt that conforms generally to the formula:

$$—\{—CH_2C—(CH_3)—[C(O)O—CH_2CH_2—N(CH_3)_3—]\}_x^+ [CH_3SO_4]^-x$$

Other Names:

Ethanaminium, N,N,N-Trimethyl-2-[(2-Methyl-1-Oxo-2-Propenyl)Oxy]-, Methyl Sulfate, Homopolymer Reten 300 (Hercules)

Polyquaternium-15

CAS Number: 35429-19-7

Definition: Polyquaternium-15 is the copolymer of acrylamide and betamethacrylyloxyethyl trimethyl ammonium chloride.

Other Names:

Rohagit KF 400 (Rohm GmbH)

Rohagit KF 720 (Rohm GmbH)

Polyquaternium-16

Definition: Polyquaternium-16 is a polymeric quaternary ammonium salt formed from methylvinylimidazolium chloride and vinylpyrrolidone.

Other Names:

Luviquat FC 370 (BASF)

Luviquat FC 550 (BASF)

Luviquat FC 905 (BASF)

Luviquat HM-552 (BASF)

Polyquaternium-17

Definition: Polyquaternium-17 is; a polymeric quaternary salt prepared by the reaction of adipic acid and dimethylaminopropylamine, reacted with dichloroethyl ether. It conforms generally to the formula:

$$—[—N^+(CH_2)_3NH(O)C—(CH_2)_4—C(O)NH—(CH_2)_3— N(CH_3)_2—(CH_2)_2—O—(CH_2)_2—]_xCl^-_x$$

Other Names:

Mirapol AD-1 (Rhône-Poulenc)

Polyquaternium-18

Definition: Polyquaternium-18 is a polymeric quaternary salt prepared by the reaction of azelaic acid and dimethylaminopropylamine reacted with dichloroethyl ether. It conforms generally to the formula:

$$—[—N^+(CH_2)_3NH—(O)C—(CH_2)_3C(O)—NH—(CH_2)_3— N(CH_3)_2—(—CH_2)_2—O—(CH_2)_2—]_xCl^-_x$$

Other Names:

Mirapol AZ-1 (Rhône-Poulenc)

Polyquaternium-19

Definition: Polyquaternium-19 is the polymeric quaternary ammonium salt prepared by the reaction of polyvinyl alcohol with 2,3-epoxypropylamine.

Other Names:

Arlatone PQ-220 (ICI Americas)

Polyquaternium-20

Definition: Polyquaternium-20 is the polymeric quaternary ammonium salt prepared by the reaction of polyvinyl octadecyl ether with 2,3-epoxypropylamine.

Other Names:

Arlatone PQ-225 (ICI Americas)

Polyquaternium-22

CAS Number: 53694-17-0

Empirical Formula: $(C_8H_{16}NCl)$ $(C_3H_3O_2)$

Definition: Polyquaternium-22 is a copolymer of dimethyldiallyl ammonium chloride and acrylic acid. It conforms generally to the formula:

$$—[DMDA]_x—[—CH_2CH(C(O)OH)—]_y— \text{ where } —[DMDA]_x— \text{ is:}$$

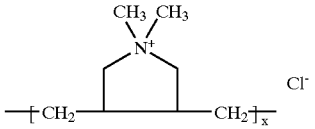

Other Names:

Merquat 280 (Calgon)

Polyquaternium-24

Definition: Polyquaternium-24 is a polymeric quaternary ammonium salt of hydroxyethyl cellulose reacted with a lauryl dimethyl ammonium substituted epoxide.

Other Names:

Quatrisoft Polymer LM-200 (Amerchol)

Polyquaternium-27

Definition: Polyquaternium-27 is the block copolymer formed by the reaction of Polyquaternium-2 with Polyquaternium-17.

Other Names:

Mirapol 9 (Rhône-Poulenc)

Mirapol-95 (Rhône-Poulenc)

Mirapol 175 (Rhône-Poulenc)

Polyquaternium-28

Definition: Polyquaternium-28 is a polymeric quaternary ammonium salt consisting of vinylpyrrolidone and dimethylaminopropyl methacrylamide monomers. It conforms generally to the formula:

$$—\{VP\}_x—\{—CH_2—CH(CH_3)[C(O)—NH—CH_2CH_2CH_2N^{30}(CH_3)_3—]\}_yCl^-_y \text{ where [VP] is:}$$

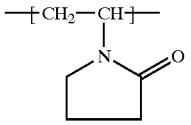

Other Names:

Gafquat HS-100 (GAF)

Vinylpyrrolidone/Methacrylamidopropyltrimethylammonium Chloride Copolymer.

Polyquaternium-29

Definition: Polyquaternium-29 is Chitosan that has been reacted with propylene oxide and quaternized with epichlorohydrin.

Other Names:

Lexquat CH (Inolex).

Polyquaternium-30

Definition: Polyquaternium-30 is the polymeric quaternary ammonium salt that conforms generally to the formula:

$$—[CH_2C(CH_3)(C(O)OCH_3)]_x—[CH_2C(CH_3)(C(O)OCH_2CH_2N^+(CH_3)_2CH_2COO^-)]_y—$$

Other Names:

Mexomere PX (Chimex)

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall), believed to be derived from guar gum of molecular weight about 220,000, and to have a degree of substitution about 0.13, wherein the cationic moiety has the formula:

$$—CH_2CH(OH)CH_2N^+(CH_3)_3Cl^-$$

Very effective also is guar gum quaternized to a D.S. of about 0.2 to 0.5 with the quaternary grouping:

$$—CH_2CH(OH)CH_2N^+(CH_3)_3Cl^-$$

or $$—CH_2CH{=}CHCH_2N^+(CH_3)_3Cl^-$$

Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The cationic guar gums are effective at levels from about 0.03 to 0.7% by weight of the compositions preferably up to 0.4%.

The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

In particular, cationic dextrins such as the above, which have molecular weights (as dextrins) in the range from about 1,000 to about 10,000, usually about 5,000, are effective scavengers for anionic surfactants. Preferably the D.S. is in the range from 0.1 upwards, especially from about 0.2 to 0.8. Also suitable are cationic starches, especially the linear fractions, amylose, quaternized in the usual ways. Usually the D.S. is from 0.01 to 0.9, preferably from 0.2 to 0.7, that is rather higher than in most conventional cationic starches.

The cationic dextrins usually are employed at levels in the range from about 0.05 to 0.7% of the composition, especially from about 0.1 to 0.5%. Polyvinyl pyridine and co-polymers thereof with for instance styrene, methyl methacrylate, acrylamides, N-vinyl pyrrolidone, quaternized at the pyridine nitrogens are very effective, and can be employed at even lower levels than the polysaccharide derivatives discussed above, for instance at 0.01 to 0.2% by weight of the composition, especially from 0.02 to 0.1%. In some instances the performance seems to fall off when the content exceeds some optimum level such as about 0.05% by weight for polyvinyl pyridinium chloride and its co-polymer with styrene.

Some very effective individual cationic polymers are the following: Polyvinyl pyridine, molecular weight about 40,000, with about 60% of the available pyridine nitrogens quaternized; Co-polymer of 70/30 molar proportions of vinyl pyridine/styrene, molecular weight about 43,000, with about 45% of the available pyridine nitrogens quaternized as above; Co-polymers of 60/40 molar proportions of vinyl pyridine/acrylamide, with about 35% of the available pyridine nitrogens quaternized as above. Co-polymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene co-polymer about 0.05%.

Some other effective cationic polymers are: Co-polymer of vinyl pyridine and N-vinyl pyrrolidone (63/37) with about 40% of the available pyridine nitrogens quaternized; Co-polymer of vinyl pyridine and acrylonitrile (60/40), quaternized as above; Co-polymer of N,N-dimethyl amino ethyl methacrylate and styrene (55/45) quaternized as above at about 75% of the available amino nitrogens. Eudragit E (Trade Name of Rohm GmbH) quaternized as above at about 75% of the available amino nitrogens. Eudragit E is believed to be co-polymer of N,N-dialkyl amino alkyl methacrylate and a neutral acrylic acid ester, and to have molecular weight about 100,000 to 1,000,000; Co-polymer of N-vinyl pyrrolidone and N,N-diethyl amino methyl methacrylate (40/50), quaternized at about 50% of the available amino nitrogens; These cationic polymers can be prepared in a known manner by quaternizing the basic polymers.

Yet other co-polymers are condensation polymers, formed by the condensation of two or more reactive monomers both of which are bifunctional. Two broad classes of these polymers can be formed which are then made cationic, viz. (a) those having a nitrogen atom which can be cationic in the back bone or which can be made cationic in the back bone.

Compounds of class (a) can be prepared by condensing a tertiary or secondary amine of formula:

$$R_{11}N(R_{12}OH)_2$$

wherein $R_{11}$ is H or a $C_{1-6}$ alkyl group, preferably methyl, or $R_{12}OH$ and each $R_{12}$ independently is a $C_{1-6}$ alkylene group, preferably ethylene, with a dibasic acid, or the corresponding acyl halide having formula $$XOOC(R_{13})COOX$$

or the anhydride thereof, wherein $R_{13}$ is a $C_{1-6}$ alkylene, hydroxy alkylene or alkenyl group or an aryl group, and X is H, or a halide preferably chloride. Some suitable acids are succinic, malic, glutaric, adipic, pimelic, suberic, maleic, ortho-, meta- and tere-phthalic, and their mono and di-chlorides. Very suitable anhydrides include maleic and phthalic anhydrides. The condensation leads to polymers having repeating units of structure $$[—R_{12}—N(R_{11})—R_{12}—O(O)C—R_{13}—C(O)O—]$$

Reactions of this sort are described in British Pat. No. 602.048. These can be rendered cationic for instance by addition of an alkyl or alkoyl halide or a di-alkyl sulphate at the back bone nitrogen atoms or at some of them. When $R_{11}$ is ($R_{12}OH$) this group can be esterified by reaction with a carboxylic acid, e.g. a $C_{1-20}$ saturated or unsaturated fatty acid or its chloride or anhydride as long as the resulting polymers remain sufficiently water soluble. When long chain, about $R_{10}$ and higher, fatty acids are employed these polymers can be described as "comb" polymers. Alternatively when $R_{11}$ is ($R_{12}OH$) the $R_{11}$ groups can be reacted with a cationic e.g. a quaternary ammonium group such as glycidyl trimethyl ammonium chloride or l-chlorobut-2-ene trimethyl ammonium chloride, and like agents mentioned hereinafter.

Some cationic polymers of this class can also be made by direct condensation of a dicarboxylic acid etc. with a difunctional quaternary ammonium compound having for instance the formula $$R_{11}R_{14}N^+(R_{12}OH)_2Z^-$$

where $R_{14}$ is an H or $C_{1-6}$ alkyl group, and $R_{11}$ and $R_{12}$ are as defined above, and $Z^-$ is an anion.

Another class of copolymer with nitrogens which can be made cationic in the back bone can be prepared by reaction of a dicarboxylic acid, etc. as defined above with a dialkylene triamine, having structure $$H_2NR_{15}N(R_{17})R_{16}NH_2$$

where $R_{15}$ and $R_{16}$ independently each represent a $C_{2-6}$ alkylene group, and $R_{17}$ is hydrogen or a $C_{1-6}$ alkyl group. This leads to polymers having the repeating unit $$[—(O)C—R_{13}—C(O)—N—R_{15}—N(R_{17})—R_{16}—NH—]$$

wherein the nitrogen not directly linked to a CO group i.e. not an amide nitrogen, can be rendered cationic, as by reaction with an alkyl halide or dialkyl sulphate.

Commercial examples of a condensation polymers believed to be of this class are sold under the generic Trade Name Alcostat by Allied Colloids.

Yet other cationic polymeric salts are quaternized polyethyleneimines. These have at least 10 repeating units, some or all being quaternized.

Commercial examples of polymers of this class are also sold under the generic Trade Name Alcostat by Allied Colloids.

It will be appreciated by those skilled in the art that these quaternization and esterification reactions do not easily go to completion, and usually a degree of substitution up to about 60% of the available nitrogen is achieved and is quite effective. Thus it should be understood that usually only some of the units constituting the cationic polymers have the indicated structures.

Polymers of class (b), with no nitrogen in the back bone can be made by reacting a triol or higher polyhydric alcohol with a dicarboxylic acid etc. as described above, employing glycerol, for example. These polymers can be reacted with cationic groups at all the hydroxyls, or at some of them.

Typical examples of the above types of polymers are disclosed in U.S. Pat. No. 4,179,382, incorporated hereinbefore by reference.

Other cationic polymers of the present invention are water-soluble or dispersible, modified polyamines. The polyamine cationic polymers of the present invention are water-soluble or dispersible, modified polyamines. These polyamines comprise backbones that can be either linear or cyclic. The polyamine backbones can also comprise polyamine branching chains to a greater or lesser degree. In general, the polyamine backbones described herein are modified in such a manner that each nitrogen of the polyamine chain is thereafter described in terms of a unit that is substituted, quaternized, oxidized, or combinations thereof.

For the purposes of the present invention the term "modification" is defined as replacing a backbone —NH hydrogen atom by an E unit (substitution), quaternizing a backbone nitrogen (quaternized) or oxidizing a backbone nitrogen to the N-oxide (oxidized). The terms "modification" and "substitution" are used interchangably when referring to the process of replacing a hydrogen atom attached to a backbone nitrogen with an E unit. Quaternization or oxidation may take place in some circumstances without substitution, but preferably substitution is accompanied by oxidation or quaternization of at least one backbone nitrogen.

The linear or non-cyclic polyamine backbones that comprise the polyamine cationic polymers of the present invention have the general formula:

$$[H_2N—R]_{n+1}—[N(H)—R]_m—[N(H)—R]_n—NH_2$$

said backbones prior to subsequent modification, comprise primary, secondary and tertiary amine nitrogens connected by R "linking" units. The cyclic polyamine backbones comprising the polyamine cationic polymers of the present invention have the general formula:

$$[H_2N—R]_{n-k+1}—[N(H)—R]_m—[N(—)—R]_n—[N(R)—R]_k—NH_2$$

wherein (—) indicates a covalent bond, said backbones prior to subsequent modification, comprise primary, secondary and tertiary amine nitrogens connected by R "linking" units For the purpose of the present invention, primary amine nitrogens comprising the backbone or branching chain once modified are defined as V or Z "terminal" units. For example, when a primary amine moiety, located at the end of the main polyamine backbone or branching chain having the structure $$[H_2N—R]—$$

is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure $$—NH_2$$

is modified according to the present invention, it is thereafter defined as a Z "terminal" unit, or simply a Z unit. This unit can remain unmodified subject to the restrictions further described herein below.

In a similar manner, secondary amine nitrogens comprising the backbone or branching chain once modified are defined as W "backbone" units. For example, when a secondary amine moiety, the major constituent of the backbones and branching chains of the present invention, having the structure $$—[N(H)—R]—$$

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, having the structure $$—[N(—)—R]—$$

wherein (—) indicates a covalent bond, is modified according to the present invention, it is thereafter defined as a Y "branching" unit, or simply a Y unit. However, for the purposes of the present invention, some or all or the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described herein below.

The final modified structure of the polyamines of the present invention can be therefore represented by the general formula $$V_{(n+1)}W_mY_nZ$$

for linear polyamine cotton soil release polymers and by the general formula $$V_{(n-k+1)}W_mY_nY'_kZ$$

for cyclic polyamine cotton soil release polymers. For the case of polyamines comprising rings, a Y' unit of the formula $$—[N(R—)—R]—$$

serves as a branch point for a backbone or branch ring. For every Y' unit there is a Y unit having the formula $$—[N(—)—R]—$$

that will form the connection point of the ring to the main polymer chain or branch. In the unique case where the backbone is a complete ring, the polyamine backbone has the formula $$[H_2N—R]_n—[N(H)—R]_m—[N(—)—R]_n—$$

therefore comprising no Z terminal unit and having the formula $$V_{n-k}W_mY_nY'_k$$

wherein k is the number of ring forming branching units. Preferably the polyamine backbones of the present invention comprise no rings.

In the case of non-cyclic polyamines, the ratio of the index n to the index m relates to the relative degree of branching. A fully non-branched linear modified polyamine according to the present invention has the formula $$VW_mZ$$

that is, n is equal to 0. The greater the value of n (the lower the ratio of m to n), the greater the degree of branching in the molecule. Typically the value for m ranges from a minimum value of 4 to about 400, however larger values of m, especially when the value of the index n is very low or nearly 0, are also preferred.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, or Z units depending on whether they are primary, secondary or tertiary nitrogens. That is unmodified primary amine nitrogens are V or Z units, unmodified secondary amine nitrogens are W units and unmodified tertiary amine nitrogens are Y units for the purposes of the present invention.

Modified primary amine moieties are defined as V "terminal" units having one of three forms:

a) simple substituted units having the structure:

$N(E_2)—R—$ b) quaternized units having the structure:

$N(E_3)—R—(X^-)$ wherein X is a suitable counter ion providing charge balance; and c) oxidized units having the structure:

$(—R)E_2)N→O$

Modified secondary amine moieties are defined as W "backbone" units having one of three forms:

a) simple substituted units having the structure:

$—N(E)—R—$ b) quaternized units having the structure:

$—N^+(E_2)—R—$ wherein X is a suitable counter ion providing charge balance; and c) oxidized units having the structure:

$—N(E)(R—)→O$

Modified tertiary amine moieties are defined as Y "branching" units having one of three forms:

a) unmodified units having the structure:

$(—)_2N—R—,$ b) quaternized units having the structure:

$(—)_2(E)N^+—R—,$ wherein X is a suitable counter ion providing charge balance; and c) oxidized units having the structure:

$—R—N(—)_2→O,$

Certain modified primary amine moieties are defined as Z "terminal" units having one of three forms:

a) simple substituted units having the structure:

$—N(E)_2$ b) quaternized units having the structure:

$—N^+(E)_3X^-$ wherein X is a suitable counter ion providing charge balance; and c) oxidized units having the structure:

$—R—N(E)_2→O,$

When any position on a nitrogen is unsubstituted, or unmodified, it is understood that hydrogen will substitute for E. For example, a primary amine unit comprising one E unit in the form of a hydroxyethyl moiety is a V terminal unit having the formula $(HOCH_2CH_2)HN—$.

For the purposes of the present invention there are two types of chain terminating units, the V and Z units. The Z "terminal" unit derives from a terminal primary amino moiety of the structure $—NH_2$. Non-cyclic polyamine backbones according to the present invention comprise only one Z unit whereas cyclic polyamines can comprise no Z units. The Z "terminal" unit can be substituted with any of the E units described further herein below, except when the Z unit is modified to form an N-oxide. In the case where the Z unit nitrogen is oxidized to an N-oxide, the nitrogen must be modified and therefore E cannot be a hydrogen.

The polyamines of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety can take any position on the R unit chain except the carbon atoms directly connected to the polyamine backbone nitrogens; $C_4$–$C_{12}$ dihydroxyalkylene wherein the hydroxyl moieties can occupy any two of the carbon atoms of the R unit chain except those carbon atoms directly connected to the polyamine backbone nitrogens; $C_8$–$C_{12}$ dialkylarylene which for the a purpose of the present invention are arylene moieties having two alkyl substituent groups as part of the linking chain. For example, a dialkylarylene unit has the formula

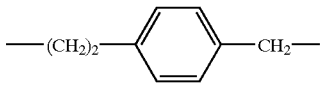

or

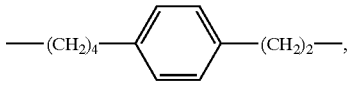

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise $—(R^1O)_xR^5(OR^1)_x—$, $CH_2CH(OR^2)CH_2O)_z(R^1O)_yR^1(OCH_2CH(OR^2)CH_2)_w—$, $—CH_2CH(OR^2)CH_2—$, $(R^1O)_xR^1—$, and mixtures thereof Preferred R units are $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $—(R^1O)_xR^1—$, $—CH_2CH(OR^2)CH_2—$, $—(CH_2CH(OH)CH_2O)_z(R^1O)_yR^1(OCH_2CH—(OH)CH_2)_w—$, $—(R^1O)_xR^5(OR^1)_x—$, more preferred R units are $C_2$–$C_{12}$ alkylene, $C_3$–$C_{12}$ hydroxy-alkylene, $C_4$–$C_{12}$ dihydroxyalkylene, $—(R^1O)_xR^1—$, $—(R^1O)_xR^5(OR^1)_x—$, $—(CH_2CH(OH)CH_2O)_z(R^1O)_yR^1(OCH_2CH—(OH)CH_2)_w—$, and mixtures thereof, even more preferred R units are $C_2$–$C_{12}$ alkylene, $C_3$ hydroxyalkylene, and mixtures thereof, most preferred are $C_2$–$C_6$ alkylene. The most preferred backbones of the present invention comprise at least 50% R units that are ethylene.

$R^1$ units are $C_2$–$C_6$ alkylene, and mixtures thereof, preferably ethylene.

$R^2$ is hydrogen, and $—(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof, preferably $C_1$–$C_{12}$ acyl, $C_7$–$C_{12}$ arylalkylene, more preferably $C_1$–$C_{12}$ alkyl, most preferably methyl. $R^3$ units serve as part of E units described hereinbelow.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —C(O)NHR$^6$NHC(O)—, —C(O)(R$^4$)$_r$C(O)—, —R$^1$(OR$^1$)—, —CH$_2$CH(OH)CH$_2$O(R$^1$O)$_y$R$^1$OCH$_2$CH(OH)CH$_2$—, —C(O)(R$^4$)$_r$C(O)—, —CH$_2$CH(OH)CH$_2$—, $R^5$ is preferably ethylene, —C(O)—, —C(O)NHR$^6$NHC(O)—, —R$^1$(OR$^1$)—, —CH$_2$CH(OH)CH$_2$—, —CH$_2$CH(OH)CH$_2$O(R$^1$O)$_y$R$^1$OCH$_2$CH—(OH)CH$_2$—, more preferably —CH$_2$CH(OH)CH$_2$—.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred cotton soil release agents of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —(CH$_2$CH$_2$O)$_x$R$^5$(OCH$_2$CH$_2$)$_x$— yields —(CH$_2$CH$_2$O)$_x$CH$_2$CHOHCH$_2$(OCH$_2$CH$_2$)$_x$—.

ii) Substituting preferred $R^1$ and $R^2$ into —(CH$_2$CH(OR$^2$)CH$_2$O)$_z$—(R$^1$O)$_y$R$^1$O(CH$_2$CH(OR$^2$)CH$_2$)$_w$— yields —(CH$_2$CH(OH)CH$_2$O)$_z$—(CH$_2$CH$_2$O)$_y$CH$_2$CH$_2$O(CH$_2$CH(OH)CH$_2$)$_w$—.

iii) Substituting preferred $R^2$ into —CH$_2$CH(OR$^2$)CH$_2$— yields —CH$_2$CH(OH)CH$_2$—.

E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —(CH$_2$)$_p$CO$_2$M, —(CH$_2$)$_q$SO$_3$M, —CH(CH$_2$CO$_2$M)CO$_2$M, —(CH$_2$)$_p$PO$_3$M, —(R$^1$O)$_m$B, —C(O)R$^3$, preferably hydrogen, $C_2$–$C_{22}$ hydroxyalkylene, benzyl, $C_1$–$C_{22}$ alkylene, —(R$^1$O)$_m$B, —C(O)R$^3$, —(CH$_2$)$_p$CO$_2$M, —(CH$_2$)$_q$SO$_3$M, —CH(CH$_2$CO$_2$M)CO$_2$M, more preferably $C_1$–$C_{22}$ alkylene, —(R$^1$O)$_x$B, —C(O)R$^3$, —(CH$_2$)$_p$CO$_2$M, —(CH$_2$)$_q$SO$_3$M, —CH(CH$_2$CO$_2$M)CO$_2$M, most preferably $C_1$–$C_{22}$ alkylene, —(R$^1$O)$_x$B, and —C(O)R$^3$. When no modification or substitution is made on a nitrogen then hydrogen atom will remain as the moiety representing E.

E units do not comprise hydrogen atom when the V, W or Z units are oxidized, that is the nitrogens are N-oxides. For example, the backbone chain or branching chains do not comprise units of the following structures:

$$(—)_{0\text{-}1}(R)_{0\text{-}1}(H)_{1\text{-}2}N{\rightarrow}O$$

Additionally, E units do not comprise carbonyl moieties directly bonded to a nitrogen atom when the V, W or Z units are oxidized, that is, the nitrogens are N-oxides. According to the present invention, the E unit —C(O)R$^3$ moiety is not bonded to an N-oxide modified nitrogen, that is, there are no N-oxide amides having the structures $$R^3—C(O)N(E)_{0\text{-}1}(—)_{0\text{-}1}{\rightarrow}O$$

or combinations thereof.

B is hydrogen, $C_1$–$C_6$ alkyl, —(CH$_2$)$_q$SO$_3$M, —(CH$_2$)$_p$CO$_2$M, —(CH$_2$)$_q$—(CHSO$_3$M)CH$_2$SO$_3$M, —(CH$_2$)$_q$(CHSO$_2$M)CH$_2$SO$_3$M, —(CH$_2$)$_p$PO$_3$M, —PO$_3$M, preferably hydrogen, —(CH$_2$)$_q$SO$_3$M, —(CH$_2$)$_q$(CHSO$_3$M)CH$_2$SO$_3$M, —(CH$_2$)$_q$—(CHSO$_2$M)CH$_2$SO$_3$M, more preferably hydrogen or —(CH$_2$)$_q$SO$_3$M.

M is hydrogen or a water soluble cation in sufficient amount to satisfy charge balance. For example, a sodium cation equally satisfies —(CH$_2$)$_p$CO$_2$M, and —(CH$_2$)$_q$SO$_3$M, thereby resulting in —(CH$_2$)$_p$CO$_2$Na, and —(CH$_2$)$_q$SO$_3$Na moieties. More than one monovalent cation, (sodium, potassium, etc.) can be combined to satisfy the required chemical charge balance. However, more than one anionic group may be charge balanced by a divalent cation, or more than one mono-valent cation may be necessary to satisfy the charge requirements of a poly-anionic radical. For example, a —(CH$_2$)$_p$PO$_3$M moiety substituted with sodium atoms has the formula —(CH$_2$)$_p$PO$_3$Na$_3$. Divalent cations such as calcium ($Ca^{2+}$) or magnesium ($Mg^{2+}$) may be substituted for or combined with other suitable mono-valent water soluble cations. Preferred cations are sodium and potassium, more preferred is sodium.

X is a water soluble anion such as chlorine ($Cl^-$), bromine ($Br^-$) and iodine ($I^-$) or X can be any negatively charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; k is less than or equal to the value of n; m has the value from 4 to about 400, n has the value from 0 to about 200; m+n has the value of at least 5.

The preferred polyamine cationic polymers of the present invention comprise polyamine backbones wherein less than about 50% of the R groups comprise "oxy" R units, preferably less than about 20%, more preferably less than 5%, most preferably the R units comprise no "oxy" R units.

The most preferred polyamine cationic polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The polyamine cationic polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone. The proper manipulation of these "R unit chain lengths" provides the formulator with the ability to modify the solubility and fabric substantivity of the polyamine cationic polymers of the present invention.

One type of preferred polyamine cationic polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneamines (PAA's), polyalkyleneimines (PAI's), preferably polyethyleneamine (PEA's), polyethyleneimines (PEI's), or PEA's or PEI's connected by moieties having longer R units than the parent PAA's, PAI's, PEA's or PEI's. A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and teraethylenepentamine (TEPA). Above the pentamnines, i.e., the hexamaines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Preferred amine polymer backbones comprise R units that are $C_2$ alkylene (ethylene) units, also known as polyethylenimines (PEI's). Preferred PEI's have at least moderate branching, that is the ratio of m to n is less than 4:1, however PEI's having a ratio of m to n of about 2:1 are most preferred. Preferred backbones, prior to modification have the general formula:

$$[H_2NCH_2CH_2]_n—[N(H)CH_2CH_2]_m—N(—)CH_2CH_2]_nNH_2$$

wherein (—), m, and n are the same as defined herein above. Preferred PEI's, prior to modification, will have a molecular weight greater than about 200 daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of modified polyamine cationic polymers of the present invention comprising PEI's, are illustrated in Formulas I–II:

Formula I depicts a polyamine cationic polymer comprising a PEI backbone wherein all substitutable nitrogens are modified by replacement of hydrogen with a polyoxyalkyleneoxy unit, $—(CH_2CH_2O)_7H$, having the formula Formula I

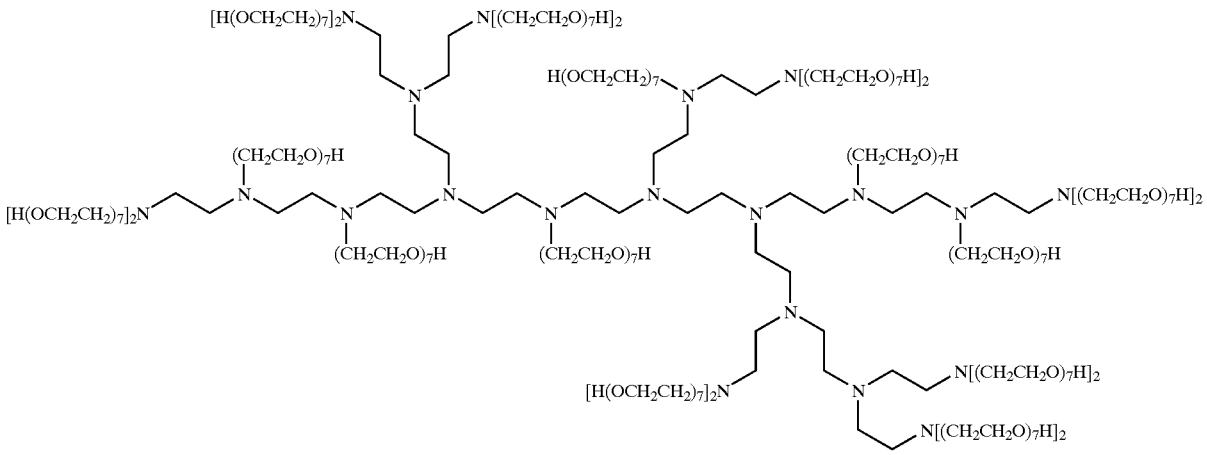

This is an example of a polyamine cationic polymer that is fully modified by one type of moiety.

Formula II depicts a polyamine cationic polymer comprising a PEI backbone wherein all substitutable primary amine nitrogens are modified by replacement of hydrogen with a polyoxyalkyleneoxy unit, $—(CH_2CH_2O)_7H$, the molecule is then modified by subsequent oxidation of all oxidizable primary and secondary nitrogens to N-oxides, said polyamine cationic polymer having the formula Formula II

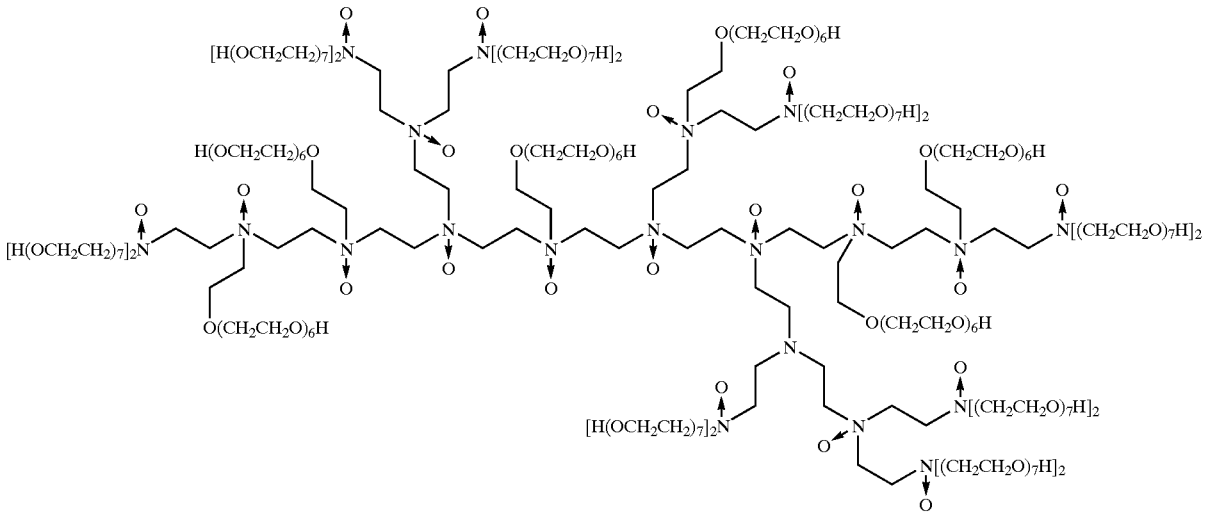

Another related polyamine cationic polymer comprises a PEI backbone wherein all backbone hydrogen atoms are substituted and some backbone amine units are quaternized. The substituents are polyoxyalkyleneoxy units, —$(CH_2CH_2O)_7H$, or methyl groups. Yet another related polyamine cationic polymer comprises a PEI backbone wherein the backbone nitrogens are modified by substitution (i.e. by —$(CH_2CH_2O)_7H$ or methyl), quaternized, oxidized to N-oxides or combinations thereof.

These polyamine cationic polymers, in addition to providing improved softening, can operate as cotton soil release agents, when used in an effective amount, e.g., from about 0.001% to about 10%, preferably from about 0.01% to about 5%, and more preferably from about 0.1% to about 1%.

Preferred cationic polymeric materials, as discussed hereinbefore, are the cationic polysaccharides, especially cationic galactomannam gums (such as guar gum) and cationic derivatives. These materials are commercially available and relatively inexpensive. They have good compatibility with cationic surfactants and allow stable, highly effective softening compositions according to the invention to be prepared. Such polymeric materials are preferably used at a level of from 0.03% to 0.5% of the composition.

Of course, mixtures of any of the above described cationic polymers can be employed, and the selection of individual polymers or of particular mixtures can be used to control the physical properties of the compositions such as their viscosity and the stability of the aqueous dispersions.

These cationic polymers are usually effective at levels of from about 0.001% to about 10% by weight of the compositions depending upon the benefit sought. The molecular weights are in the range of from about 500 to about 1,000,000, preferably from about 1,000 to about 500,000, more preferably from about 1,000 to about 250,000.

In order to be effective, the cationic polymers herein should be, at least to the level disclosed herein, in the continuous aqueous phase. In order to ensure that the polymers are in the continuous aqueous phase, they are preferably added at the very end of the process for making the compositions. The fabric softener actives are normally present in the form of vesicles. After the vesicles have formed, and while the temperature is less than about 85° F., the polymers are added.

Optional Viscosity/Dispersibility Modifiers

As stated before, relatively concentrated compositions of the unsaturated DEQA can be prepared that are stable without the addition of concentration aids. However, the compositions of the present invention usually benefit from the presence of organic and/or inorganic concentration aids at higher concentrations and/or to meet higher stability standards depending on the other ingredients. These concentration aids which typically can be viscosity modifiers can help ensure stability under extreme conditions when particular softener active levels in relation to IV are present.

This relationship between IV and the concentration where concentration aids are needed in a typical aqueous liquid fabric softener composition containing perfume can be defined, at least approximately, by the following equation (for IVs of from greater than about 25 to less than about 100): Concentration of Softener Active (Wt. %)=4.85+0.838 (IV)−0.00756 $(IV)^2$ (where $R^2$=0.99). Above these softener active levels, concentration aids are usually beneficial. These numbers are only approximations and if other variables of the formulation change, such as solvent, other ingredients, fatty acids, etc., concentration aids can be required for slightly lower concentrations or not required for slightly higher concentrations. For non-perfume or low level perfume compositions ("unscented" compositions), higher concentrations are possible at given IV levels. If the formulation separates, concentration aids can be added to achieve the desired criteria.

I. Surfactant Concentration Aids

The optional surfactant concentration aids are typically selected from the group consisting of (1) single long chain alkyl cationic surfactants; (2) nonionic surfactants; (3) amine oxides; (4) fatty acids; or (5) mixtures thereof. The levels of these aids are described below.

(1) The Single-Lone-Chain Alkyl Cationic Surfactant

The mono-long-chain-alkyl (water-soluble) cationic surfactants:

I. in solid compositions are at a level of from 0% to about 15%, preferably from about 3% to about 15%, more preferably from about 5% to about 15%, and II. in liquid compositions are at a level of from 0% to about 15%, preferably from about 0.5% to about 10%, the total single-long-chain cationic surfactant being at least at an effective level.

Such mono-long-chain-alkyl cationic surfactants useful in the present invention are, preferably, quaternary ammonium salts of the general formula:

$$[R^2N^+R_3]X^-$$

wherein the $R^2$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester andlor $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the viscosity and/or increase the dispersibility of the diester softener and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse. However, the cationic polymers of this invention will serve this function, so it is preferable to keep the level of single long chain cationic materials low, preferably less than about 10%, more preferably less than about 7%, to minimize such extraneous materials.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc.

Any of the alkoxylated materials of the particular type described hereinafter can be used as the nonionic surfactant. In general terms, the nonionics herein, when used alone, I. in solid compositions are at a level of from about 5% to about 20%, preferably from about 8% to about 15%, and II. in liquid compositions are at a level of from 0% to about 5%, preferably from about 0.1% to about 5%, more preferably from about 0.2% to about 3%. Suitable compounds are substantially water-soluble surfactants of the general formula:

$$—R^2—Y—(C_2H_4O)_z—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R^2$, and R, when present, have the meanings given hereinbefore, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxyl (EO) groups in the molecule.

a. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention.

Exemplary ethoxylated primary alcohols useful herein as the viscosityldispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallowalcohol-EO(11), tallowalcohol-EO (18), and tallowalcohol-EO(25).

b. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and BLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

c. Alkyl Phenol Alkoxylates

As in the case of the alcohol alkoxylates, the hexa- through octadeca-ethoxylates of alkylated phenols, particularly monohydric alkylphenols, having an HLB within the range recited herein are usefull as the viscosity/dispersibility modifiers of the instant compositions. The hexa- through octadeca-ethoxylates of p-tridecyl-phenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

d. Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

e. Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(3) Amine Oxides

Suitable amine oxides include those with one alkyl or hydroxyalkyl moiety of about 8 to about 28 carbon atoms, preferably from about 8 to about 16 carbon atoms, and two alkyl moieties selected from the group consisting of alkyl groups and hydroxyalkyl groups with about 1 to about 3 carbon atoms.

The amine oxides:

I. in solid compositions are at a level of from 0% to about 15%, preferably from about 3% to about 15%; and II. in liquid compositions are at a level of from 0% to about 5%, preferably from about 0.25% to about 2%, the total amine oxide present at least at an effective level.

Examples include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(4) Fatty Acids

Suitable fatty acids include those containing from about 12 to about 25, preferably from about 13 to about 22, more preferably from about 16 to about 20, total carbon atoms, with the fatty moiety containing from about 10 to about 22, preferably from about 10 to about 18, more preferably from about 10 to about 14 (mid cut), carbon atoms. The shorter moiety contains from about 1 to about 4, preferably from about 1 to about 2 carbon atoms.

Fatty acids are present at the levels outlined above for amine oxides. Fatty acids are preferred concentration aids for those compositions which require a concentration aid and contain perfume.

II. Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and can improve softness performance. These agents can stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

(C) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. Use of antioxidants and reductive agent stabilizers is especially critical for unscented or low scent products (no or low perfume).

Examples of antioxidants that can be added to the compositions of this invention include a mixture of ascorbic acid, ascorbic palmitate, propyl gailate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and TironR, available from Kodak with a chemical name of 4,5-dihydroxy-m-benzene-sulfonic acid/sodium salt, and DTPAR, available from Aldrich with a chemical name of diethylenetriaminepentaacetic acid.. The chemical names and CAS numbers for some of the above stabilizers are listed in Table II below.

TABLE II

| Antioxidant | CAS No. | Chemical Name used in Code of Federal Regulations |
|---|---|---|
| Irganox ® 1010 | 6683-19-8 | Tetrakis [methylene(3,5-di-tert-butyl-4 hydroxyhydrocinnamate)] methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocin-nammamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis[monoethyl(3,5-di-tert-butyl-4-hydroxybenzyl) phosphonate] |
| Irganox ® 3114 | 27676-62-6 | 1,3,5-Tris(3,5-di-tert-butyl-4-hydroxybenzyl)-s-triazine-2,4,6-(1H, 3H, 5H)trione |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof (D) Liquid Carrier The liquid carrier employed in the instant compositions is preferably at least primarily water due to its low cost relative availability, safety, and environmental compatibility. The level of water in the liquid carrier is at least about 50%, preferably at least about 60%, by weight of the carrier. The level of liquid carrier is less than about 70, preferably less than about 65, more preferably less than about 50. Mixtures of water and low molecular weight, e.g., <100, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

(E) Optional Ingredients (1) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sept. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commmercially available materials Zelcon® 4780 (from DuPont) and Milease® T (from ICI).

Highly preferred soil release agents are polymers of the generic formula (I):

$$X—(OCH_2CH_2)_n(O—(O)C—R^1—C(O)—OR^2)_u(O—(O)C—R^1—C(O)—O)(CH_2CH_2O—)_n—X \quad (I)$$

in which X can be any suitable capping group, with each X being selected from the group consisting of H, and alkyl or acyl groups containing from about 1 to about 4 carbon atoms, preferably methyl. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the RI comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof Preferably, the $R^2$ moieties are essentially ethylene moieties, 1,2-propylene moieties or mixture thereof. Inclusion of a greater percentage of ethylene moieties tends to improve the soil release activity of compounds. Inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Pat. Application 185,427, Gosselink, published Jun. 25, 1986, incorporated herein by reference.

(2) Optional Bacteriocides

Examples of bacteriocides that can be used in the compositions of this invention are parabens, especially methyl, glutaraldehyde, formaldehyde, 2-bromo-2-nitropropane-1, 3-diol sold by Inolex Chemicals under the trade name Bronopol®, and a mixture of 5-chloro-2-methyl4-isothiazoline-3-one and 2-methyl-4-isothiazo-line-3-one sold by Rohm and Haas Company under the trade name Kathon® CG/ICP. Typical levels of bacteriocides used in the present compositions are from about 1 to about 2,000 ppm by weight of the composition, depending on the type of bacteriocide selected. Methyl paraben is especially effective for mold growth in aqueous fabric softening compositions with under 10% by weight of the diester compound.

(3) Other Optional Ingredients

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-corrosion agents, antifoam agents, enzymes such as cellulases, proteases, and the like.

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to DEQA is from about 1:6 to about 1:2, preferably from about 1:4 to about 1:2. The level of optional nonionic softener in the liquid composition is typically from about 0.5% to about 10%, preferably from about 1% to about 5%.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4—and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

(F) Compositions

Other compositions that can contain the cationic polymers herein include the "clear" compositions described in the copending U.S. patent application: Ser. Nos. 08/621,019; 08/620,627; 08/620,767; 08/620,513; 08/621,285; 08/621,299; 08/621,298; 08/620,626; 08/620,625; 08/620,772; 08/621,281; 08/620,514; and 08/620,958, all filed Mar. 22, 1996 and all having the title "CONCENTRATED, STABLE, PREFERABLY CLEAR, FABRIC SOFTENING COMPOSITION", all of said compositions being incorporated herein by reference.

Other low softener, high perfume, compositions, disclosed in the copending provisional application of Cristina Avila-Garcia, et al., Ser. No. 60/007,224, filed Nov. 3, 1995, for "Stable High Perfume, Low-Active Fabric Softener Compositions", said application being incorporated hereinbefore by reference, can be prepared using the cationic polymers including: single strength liquid fabric softener compositions for use in the rinse cycle of a laundering process, the compositions comprising:

(a) from about 0.4% to about 5% cationic fabric softener;
(b) from about 0.3% to about 1.2% hydrophobic perfume;
(c) from about 0.4% to about 5% nonionic surfactant dispersibility aid;
(d) from 0% to about 1% water-soluble ionizable inorganic salt;
(e) from about 90% to about 98.5% water;
(f) an effective amount up to about 40%, of high boiling water soluble solvent;
(g) an effective amount, as disclosed hereinbefore of cationic polymer and
(h) from 0% to about 2% other ingredients; the ratio of cationic softener to perfume being from about 1:3 to about 5:1; the ratio of cationic softener to nonionic surfactant being from about 1:2 to about 4:1, and the amount of cationic softener plus nonionic surfactant being from about 1% to about 7%. The compositions consist of a liquid aqueous phase with discrete hydrophobic particles dispersed substantially uniformly therein. The compositions preferably have a viscosity of from about 50 cp to about 500 cp.

(G) A Preferred Process for Preparation of Concentrated Aqueous Biodegradable Textile Softener Compositions (Dispersions)

This invention also includes a preferred process for preparing aqueous biodegradable quaternary ammonium fabric softener compositions/dispersions containing cationic polymers providing a softness improvement. Key to this invention is the incorporation of the cationic polymer into the aqueous phase of the dispersion, providing better performance for softening improvements and improved long term stability of the finished products.

For example, molten organic premix of the fabric softener active and any other organic materials, except the cationic polymer, and, preferably not the perfume, is prepared and dispersed into a water seat comprising water at about 145–175° F. High shear milling is conducted at a temperature of about 140–160° F. Electrolyte, as described hereinbefore, is then added in a range of from about 400 ppm to about 7,000 ppm as needed to control viscosity. If the mixture is too viscous to mill properly, electrolyte can be added prior to milling to achieve a manageable viscosity. The dispersion is then cooled to ambient temperature and the remaining electrolyte is added, typically in an amount of from about 600 ppm to about 8,000 ppm at ambient temperature. As a preferred method, perfume is added at ambient temperature before adding the remaining electrolyte.

Preferably, the cationic polymer is added to the dispersion after the dispersion has been cooled to ambient temperatures, e.g., 70–85° F. More preferably, the cationic polymer is added after ingredients such as soil release polymers and perfumes, and most preferably, the cationic polymer is added to the dispersion after the final addition of the electrolyte.

In the method aspect of this invention, fabrics or fibers are contacted with an effective amount, generally from about 10 ml to about 150 ml (per 3.5 kg of fiber or fabric being treated) of the softener actives (including diester compound) herein in an aqueous bath. Of course, the amount used is based upon the judgment of the user, depending on concentration of the composition, fiber or fabric type, degree of softness desired, and the like. Preferably, the rinse bath contains from about 10 to about 1,000 ppm, preferably from about 50 to about 500 ppm, of the DEQA fabric softening compounds herein.

EXAMPLE I

Softness Benefits of the Use of Cationic Polymers

| Component | Ia Wt % | Ib Wt % | Ic Wt % |
|---|---|---|---|
| Diester Compound[1] (83%) | 28.20 | 28.20 | 28.20 |
| Hydrochloric Acid (1%) | 1.50 | 1.50 | 1.50 |
| DC 2310 Antifoam (10%) | 0.25 | 0.25 | 0.25 |
| $CaCl_2$ (2.5%) | 8.00 | 8.00 | 8.00 |
| Soil Release Polymer[4] (40%) | 1.25 | 1.25 | 1.25 |
| DTPA[5] acid solution (27.8%) | 9.00 | 9.00 | 9.00 |
| Perfume | 1.28 | 1.28 | 1.28 |
| Ammonium Chloride (25%) | 0.40 | 0.40 | 0.40 |
| $CaCl_2$ (25%) | 1.60 | 1.60 | 1.60 |
| Cypro 514[2] (50%) | — | 0.40 | — |
| Magnifloc 587c[3] (20%) | — | — | 1.00 |
| Blue Colorant (0.5%) | 0.68 | 0.68 | 0.68 |
| DI Water | Balance | Balance | Balance |
| pH | 2.78 | 2.77 | 2.7 |
| Viscosity (cps) | 25 | 50 | 30 |

The above compositions are made by the following process:

1. Separately heat the DI water to 155±5° F. and the Diester softener mix to 165±5° F.
2. Add the DC 2310 antifoam and the HCl to the water seat.
3. Add the Diester softener mix and mill with a high speed three stage IKA mill.
4. Add the 2.5% $CaCl_2$ solution with vigorous mixing.
5. Cool the product mix to ambient temperatures (approximately 70–80° F.).
6. In the order listed above (except water), add each remaining ingredient with adequate mixing between each addition.

Controlled Softness Testing of Each Product is Performed with the Following Procedure Wash Conditions 22 gallons of water, 95° F. wash, 62° F. rinse, and 14 min. normal wash cycle. The same load was used in each case with 6 100% cotton terry fabric pieces included for softness evaluation.

Procedure

1) During the wash cycle, pour about 86 g of detergent (Tide powder) into the washer (about 22 gallons of water).
2) During the rinse cycle, when the rinse water is ⅓ in add about 30 g. of liquid fabric softener.
3) Dry the bundles for about 45 minutes (45 min. hot, 10 min. cool down).
4) Remove softness terry fabric pieces for grading.
5) Grading is set up in a 2 treatment/8 repetitions pair test
6) Strip bundles by standard procedures in the washer Results indicate the following (all scores in panelist score units (PSU) where 0=equal; 1=I think this one is better (unsure); 2=I know this one is better; 3=This one is a lot better, and 4=This one is a whole lot better, versus a marketed control product used as an arbitrary standard):

| Δ PSU | | | |
|---|---|---|---|
| Product | Test 1 | Test 2 | Average |
| Ia | +.90 | +1.09 | +1.00 |
| Ib | +1.41 | +1.27 | +1.34 |
| Ic | +1.89 | +1.64 | +1.77 |

EXAMPLE II

Importance of Incorporating the Cationic Polymers into the Aqueous Phase of the Fabric Conditioners for Stability

| Component | IIa Wt % | IIb Wt % |
|---|---|---|
| Diester Compound[1] (84.5%) | 27.57 | 27.60 |
| PEI 1200E1[6] in Oil Seat | 3.00 | — |
| Hydrochloric Acid (25%) | 0.12 | 0.12 |
| DC 2310 Antifoam (10%) | 0.10 | 0.10 |
| $CaCl_2$ (2.5%) | 14.00 | 14.00 |
| Soil Release Polymer[4] (40%) | 1.25 | 1.25 |
| PEI 1200E1[6] acid solution (30%) | — | 9.00 |
| Perfume | 1.28 | 1.28 |
| $CaCl_2$ (25%) | 0.68 | 0.68 |
| Blue Colorant (10%) | 0.05 | 0.05 |
| Kathon CG (1.5%) | 0.02 | 0.02 |
| DI Water | Balance | Balance |
| pH | 8.18 | 2.33 |
| Viscosity (cps) | 195 | 40 |
| Viscosity (cps) after 1 week at ambient | >500 | 45 |

As can be seen, the addition of the cationic polymer to the softener (oil seat) results in product instability.

The above compositions are made by the following process:

1. Separately heat the DI water to 155±5° F. and a blend of the Diester softener mix and PEI 1200E1 to 165±5° F., mixing thoroughly after heating, for IIa. Heat the Diester softener mix separately to 165±5° F. for formula IIb.

2. Add the DC 2310 antifoam and the HCl to the water seat and mix.
3. Add the Diester softener and PEI premix for IIa or the Diester softener premix for IIb into the water seat over 5–6 minutes. During the injection, both mix (600–1,000 rpm) and mill (8,000 rpm with an IKA Ultra Turrax T-50 Mill) the batch.
4. Add the 2.5% $CaCl_2$ solution with vigorous mixing.
5. Cool the product mix to ambient temperatures (approximately 70–80° F.).
6. In the order listed above (except water), add each remaining ingredient with adequate mixing between each addition.

EXAMPLE III

Importance of Incorporating the Cationic Polymers into the Aqueous Phase of the Fabric Conditioners for Softness

| Component | IIIa Wt % | IIIb Wt % |
|---|---|---|
| Diester Compound[1] (84.5%) | 27.57 | 27.60 |
| Cypro 514[2] (50%) | 0.40 | 0.40 |
| Hydrochloric Acid (25%) | 0.12 | 0.12 |
| DC 2310 Antifoam (10%) | 0.10 | 0.10 |
| $CaCl_2$ (25%) | 14.00 | 14.00 |
| Soil Release Polymer[4] (40%) | 1.25 | 1.25 |
| Perfume | 1.28 | 1.28 |
| $CaCl_2$ (25%) | 0.68 | 0.68 |
| Blue Colorant (10%) | 0.05 | 0.05 |
| Kathon CG (1.5%) | 0.02 | 0.02 |
| DI Water | Balance | Balance |
| pH | 2.21 | 2.15 |
| Viscosity (cps) | 33 | 55 |
| Softness grade versus marketed control (Δ PSU) | −0.14 | +0.73 |

The above compositions are made by the following process:

1. Separately heat the DI water to 155±5° F. and, for IIIa, a blend of the Diester softener mix and Cypro 514 to 165±5° F., is mixed thoroughly after heating, and for IIIb The Diester softener mix is heated separately to 165±5° F.
2. Add the DC 2310 antifoam and the HCl to the water seat and mix.
3. Add the Diester softener and Cypro 514 premix for IIIa or the Diester softener premix for IIIb into the water seat over 5–6 minutes. During the injection, both mix (600–1, 000 rpm) and mill (8,000 rpm with an IKA Ultra Turrax T-50 Mill) the batch.
4. Add the 2.5% $CaCl_2$ solution with vigorous mixing.
5. Cool the product mix to ambient temperatures (approximately 70–80° F.).
6. In the order listed above(except water), and except for the Cypro 514 for formula IIIb which is to be added after the soil release polymer, add each remaining ingredient with adequate mixing between each addition.

EXAMPLE IV

Softness Benefits of the Use of Cationic Polymers

| Component | IVa Wt % | IVb Wt % | IVc Wt % | IVd Wt % |
|---|---|---|---|---|
| Diester Compound[1] (84.5%) | 23.74 | 23.74 | 23.74 | 23.74 |
| Hydrochloric Acid (1%) | 2.15 | 2.15 | 2.15 | 2.15 |
| DC 2310 Antifoam (10%) | 0.25 | 0.25 | 0.25 | 0.25 |
| $CaCl_2$ (2.5%) | 11.82 | 10.18 | 10.18 | 10.18 |

-continued

| Component | IVa Wt % | IVb Wt % | IVc Wt % | IVd Wt % |
|---|---|---|---|---|
| Soil Release Polymer (40%) | 1.08 | 2.15 | 2.15 | 2.15 |
| PEI 1200 E1[6] acid solution (30%) | — | 10.00 | — | 10.00 |
| Tinofix ECO[7] (46.3%) | — | — | 6.48 | 6.48 |
| Perfume | 1.10 | 1.10 | 1.10 | 1.10 |
| $CaCl_2$ (25%) | 0.58 | 1.37 | 1.37 | 1.37 |
| Blue Colorant (0.5%) | 0.33 | 0.33 | 0.33 | 0.33 |
| DI Water | Balance | Balance | Balance | Balance |
| pH | 2.68 | 2.59 | 2.77 | 2.58 |
| Viscosity (cps) | 28 | 20 | 25 | 20 |
| Softness grade versus market control (Δ PSU)) | +1.16 | +1.59 | +1.59 | +1.81 |

The above compositions are made by the following process:

1. Separately heat the DI water to 155±5° F. and the Diester softener mix to 165±5° F.
2. Add the DC 2310 antifoam and the HCl to the water seat.
3. Add the Diester softener mix and mill with a high speed three stage Tekmar mill.
4. Add the 2.5% $CaCl_2$ solution with vigorous mixing.
5. Cool the product mix to ambient temperatures (approximately 70–80° F.).
6. In the order listed above (except water), add each remaining ingredient with adequate mixing between each addition.

EXAMPLE V

| Component | Va Wt % | Vb Wt % | Vc Wt % |
|---|---|---|---|
| Diester Compound[1] (100%) | 26.0 | 34.7 | 26.0 |
| 1,2-Hexanediol | 17.0 | 22.0 | — |
| TMPD | — | — | 15.0 |
| 1,4 Cyclohexanedimethanol | — | — | 5.0 |
| Hexylene Glycol | 2.3 | 3.05 | 2.3 |
| Ethanol | 2.3 | 3.05 | 2.3 |
| HCl (1N) | 0.3 | 0.4 | 0.3 |
| Cypro 514 | 0.2 | 0.5 | 0.2 |
| Diethylenetriaminepentaacetic acid | 0.01 | 0.01 | 0.01 |
| Perfume | 1.25 | 1.70 | 1.25 |
| Kathon (1.5%) | 0.02 | 0.02 | 0.02 |
| Blue Dye | 0.003 | 0.003 | 0.003 |
| DI Water | 50.60 | 34.60 | 47.60 |

What is claimed is:

1. Aqueous fabric softener composition comprising:

(A) cationic fabric softening compound having the formula:

$$(R)_{4-m}—N^+—[(CH_2)_n—Y—R^2]_mX^-$$

wherein each Y=—O—(O)C—, —C(O)—O—, —NR—(O)C—, or —C(O)—NR—; m=2 or 3; each n=1 to 4; each R substituent is a short chain $C_1$–$C_6$ alkyl, hydroxyalkyl, or benzyl group or mixtures thereof; each $R^2$ is a long chain, $C_{11}$–$C_{21}$ hydrocarbyl, or substituted hydrocarbyl substituent and the counterion, $X^-$, is any softener-compatible anion; wherein said cationic fabric softening compound is in the composition in the form of vesicles; and (B) at least an effective amount of cationic polymer to improve the softening of the cationic fabric softening compound, said cationic polymer being water soluble to the extent of at least 0.5% by weight at 20° C. and having a concentration in the aqueous phase of from about 0.001% to about 10%;

wherein the vesicles are formed prior to introduction of the cationic polymer into the composition.

2. The composition according to claim 1 wherein said cationic fabric softening compound has the structure:

$$(R)_{4-m}—N^+—[(CH_2)_n—Y—R^2]_mX^-$$

wherein each Y is —O—(O)C—, or —C(O)—O—;

m is 2 or 3;

n is 1 to 4;

each R is a $C_1$–$C_6$ alkyl group, benzyl group, or mixtures thereof;

each $R^2$ is a $C_{11}$–$C_{21}$ hydrocarbyl or substituted hydrocarbyl substituent; and $X^-$ is any softener-compatible anion;

wherein the compound is derived from $C_{12}$–$C_{22}$ fatty acyl groups having an Iodine Value of from greater than about 5 to less than about 140.

3. The composition according to claim 2 wherein the iodine value is from about 40 to about 130.

4. The composition according to claim 1 wherein $R^2$ is derived from fatty acid containing at least 90% $C_{16}$–$C_{18}$ chainlength.

5. The composition according to claim 4 wherein the Iodine Value is from about 60 to about 130.

6. The composition according to claim 1 wherein the level of the fabric softening compound is from about 10% to about 50% and the molecular weight of the cationic polymer is fm about 500 to about 1,000,000.

7. The composition according to claim 6 wherein the level of the fabric softening compound is from about 15% to about 40% and the molecular weight of the cationic polymer is from about 1,000 to about 250,000.

8. The composition according to claim 7 wherein the level of the fabric softening compound is from about 20% to about 35% and the molecular weight of the cationic polymer is from about 2,000 to about 100,000.

9. The composition according to claim 1 wherein the charge density of the cationic polymer is at least about 0.01 meq/gm.

10. The composition according to claim 9, wherein the charge density of the cationic polymer is from about 0.1 to about 8 meq/gm.

11. The composition according to claim 10 wherein the charge density of the cationic polymer is from about 0.5 to about 7 meq/gm.

12. The composition according to claim 11 wherein the charge density of the cationic polymer is from about 2 to about 6 meq/gm.

13. A stable liquid composition comprising:

(A) from about 2% to about 60% of biodegradable quaternary ammonium fabric softening compound having the formula:

$$(R)_{4-m}—N^+—[(CH_2)_n—Y—R^2]_mX^-$$

wherein each Y=—O—(O)C—, —C(O)—O—, —NR—(O)C—, or —C(O)—NR—; m=2 or 3; each n=1 to 4; each R substituent is a short chain $C_1$–$C_6$ alkyl, hydroxyalkyl, or benzyl group or mixtures thereof; each $R^2$ is a long chain, $C_{11}$–$C_{21}$ hydrocarbyl, or substituted hydrocarbyl substituent and the counterion, $X^-$, is any softener-compatible anion; wherein said fabric softening compound is in the composition in the form of vesicles;

(B) 0.001% to about 10% of cationic polymer in the aqueous phase, said cationic polymer being water soluble to the extent of at least 0.5% by weight at 20° C.; wherein the vesicles are formed prior to introduction of the cationic polymer into the composition;

(C) from about 0% to about 5% of dispersibility modifier selected from the group consisting of:

1. single-long-chain $C_{10}$–$C_{22}$ alkyl, cationic surfactant;
2. nonionic surfactant with at least 8 ethoxy moieties;
3. amine oxide;
4. $C_{12}$–$C_{25}$ fatty acid; and
5. mixtures thereof;

(D) from about 0% to about 2% of a stabilizer; and (E) aqueous liquid carrier.

14. The composition of claim 13, wherein the cationic polymer is present at a level of from about 0.1% to about 2%, and the pH is from about 2.8 to about 3.5.

15. The composition of claim 13, wherein the dispersibility modifier is selected from the group consisting of coco fatty acid, coco/tallow choline ester, and cocoamine oxide.

16. The composition of claim 13, wherein the the quaternary ammonium fabric softening compound additionally comprises corresponding monoester compound wherein the monoester compounds is less than about 10% by weight of the mixed mono- and diester compounds.

17. An aqueous fabric softening composition comprising:

(A) a cationic fabric softening compound; and (B) at least an effective amount of cationic polymer to improve the softening of the cationic fabric softening compound;

wherein said cationic fabric softening compound is in the composition in the form of vesicles formed prior to the introduction of the cationic polymer into the composition, and said cationic polymer has a concentration in the aqueous phase of from about 0.001% to about 10%.

18. A process for making an aqueous liquid softening composition of claim 7 comprising the steps of:

(A) forming a premix of the organic ingredients except for the cationic polymer and an acid water seat containing at least part of an acid;

(B) adding the premix as a liquid into said acid water seat and milling the premix and acid water seat;

(C) optionally adding an electrolyte concentration aid prior to milling;

(D) adding from about 400 ppm to about 7,000 ppm of an electrolyte concentration aid after milling; and (E) adding said cationic polymer after the addition of the electrolyte concentration aid.

19. An aqueous fabric softening composition comprising:

(A) a cationic fabric softening compound; and (B) at least an effective amount of cationic polymer to improve the softening of the cationic fabric softening compound;

wherein said cationic fabric softening compound is in the composition in the form of vesicles, and said cationic polymer is provided in the composition after formation of the vesicles and has a concentration in the aqueous phase of from about 0.001% to about 10%.

* * * * *